US005547394A

United States Patent [19]

Comstock

[11] Patent Number: 5,547,394

[45] Date of Patent: Aug. 20, 1996

[54] PANEL MOUNTED ELECTRICAL CONNECTOR

[75] Inventor: Gary M. Comstock, LaGrange, Ill.

[73] Assignee: Molex Incorporated, Lisle, Ill.

[21] Appl. No.: 401,052

[22] Filed: Mar. 8, 1995

[51] Int. Cl.[6] ..... H01R 13/73

[52] U.S. Cl. ..... 439/557

[58] Field of Search ..... 439/557

[56] References Cited

U.S. PATENT DOCUMENTS

| | | | |
|---|---|---|---|
| 2,891,103 | 6/1959 | Swengel | 174/153 |
| 3,523,269 | 3/1968 | Witek et al. | 439/557 |
| 3,790,923 | 2/1974 | Mathe | 339/128 |
| 5,131,867 | 7/1992 | Peloza et al. | 439/557 |
| 5,249,982 | 10/1993 | Funck et al. | 439/556 |

OTHER PUBLICATIONS

Mark-up of FIG. 1, U.S. Pat. No. 5,131,867.

*Primary Examiner*—P. Austin Bradley
*Assistant Examiner*—T. C. Patel
*Attorney, Agent, or Firm*—Stephen Z. Weiss

[57] ABSTRACT

A panel mounted electrical connector is adapted for mounting in an aperture in a panel. The connector includes a dielectric housing insertable along an axis through the aperture from a first surface to at least a second surface of the panel and including at least one side wall. A flexible latch arm projects from the side wall and includes a locking portion adapted to engage the second surface of the panel at the periphery of the aperture when the housing is inserted completely therethrough. A stop bar projects transversely outwardly of the side wall and includes a stop shoulder adapted to engage the first surface of the panel at the periphery of the aperture when the housing is inserted therethrough. A yieldable anti-vibration arm projects inwardly of the stop bar and is axially aligned with the flexible latch arm. The anti-vibration arm is adapted to engage the first surface of the panel and to bias the locking portion of the flexible latch arm against the second surface of the panel, thereby preventing vibration between the connector and the panel and over flexing of the anti-vibration arm.

12 Claims, 3 Drawing Sheets

PANEL MOUNTED ELECTRICAL CONNECTOR

FIELD OF THE INVENTION

This invention generally relates to the art of electrical connectors and, particularly, to a panel mounted electrical connector for mounting in an aperture in a panel.

BACKGROUND OF THE INVENTION

There are a wide variety of electrical connectors which are mountable through an aperture in a panel and for coupling to a mating connector or other complementary electrical device on a side of the panel opposite the direction of insertion of the connector. Such panel mounted connectors typically include some form of latch means in the form of latch arms for retaining the connector at a particular position relative to the aperture in the panel.

Such panel mounted electrical connectors are used in a variety of applications or environments wherein it is desirable or necessary to protect the connector components or the mating connection of the connector from vibrations due to the mounting of the connector to panels having a variety of thicknesses. The applications can range from automotive applications to refrigerators and countless other environments. Likewise, the provision of anti-vibration means can take a wide range of forms, from fastening means for rigidly fixing the connector to the panel, to more versatile means such as snap-action mounting means.

For instance, a connector housing can be molded with an integral anti-vibration arm which is yieldable or sufficiently flexible to bias the connector against its mount, such as one side of the panel, and to take up any slack which might otherwise result in rattling of the connector in response to vibrations. The anti-vibration arm could engage and yield against one side of the panel, for instance, or the anti-vibration arm might yieldably engage an abutment surface on a rigid complementary mating connector.

One of the problems with panel mounted electrical connectors, and particularly such connectors using anti-vibration arms, flanges or the like which are integral with a molded dielectric connector housing, is that the panel mounting means and the anti-vibration means take up considerable amount of space on the perimeter of the connector housing, such as one or more side walls of the housing. This is a considerable disadvantage in applications of ever-increasing miniaturization of the electrical connectors. This invention is directed to solving such problems and to providing a new and improved panel mounted electrical connector wherein the panel mounting means and anti-vibration means all are provided in a very confined space such as on a narrow side wall of the connector housing.

SUMMARY OF THE INVENTION

An object, therefore, of the invention is to provide a new and improved panel mounted electrical connector of the character described.

In the exemplary embodiment of the invention, the panel mounted electrical connector is adapted for mounting in an aperture in a panel. The connector includes a dielectric housing adapted to be inserted along an axis through the aperture from a first surface to at least a second surface of the panel, and the housing includes at least one side wall. A pair of generally parallel, axially extending ribs project from the side wall and define a channel therebetween. A flexible latch arm is located in the channel between the ribs and includes a locking portion adapted to engage the second surface of the panel at the periphery of the aperture when the housing is inserted therethrough. A yieldable anti-vibration arm is axially aligned with the flexible latch arm and is adapted to engage the first surface of the panel and to bias the locking portion of the flexible latch arm against the second surface of the panel, thereby preventing vibration between the connector and the panel. Rigid stop shoulders project transversely outwardly of the ribs and are adapted to engage the first surface of the panel at the periphery of the aperture when the housing is inserted completely therethrough and when the anti-vibration arm is flexed a preset maximum amount.

As disclosed herein, the stop shoulders are formed by stop bars protruding outwardly from the ribs. The anti-vibration arm is cantilevered inwardly from one of the stop bars so as to be located between the axially extending ribs. The flexible latch arm is cantilevered from the one side wall of the housing in a direction opposite the insertion direction of the housing.

Preferably, the dielectric housing, the axially extending ribs, the flexible latch arm, the stop shoulders and the yieldable anti-vibration arm all are portions of a unitarily molded structure. This combination of components preferably are provided on each of two opposite narrow side walls of the connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
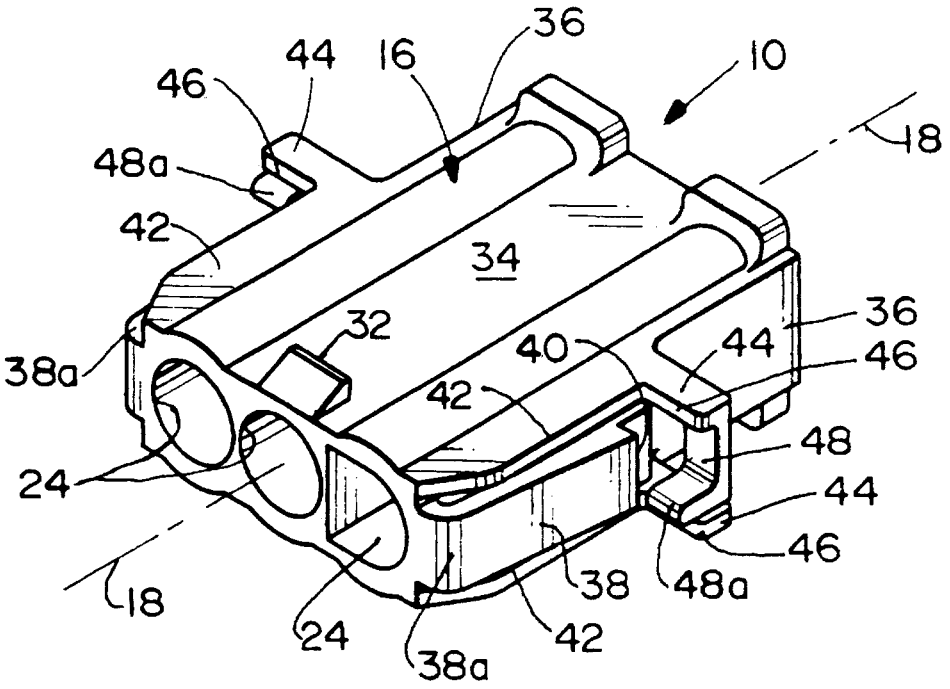
FIG. 1 is a perspective view of an electrical connector embodying the concepts of the invention.
Figure 2:
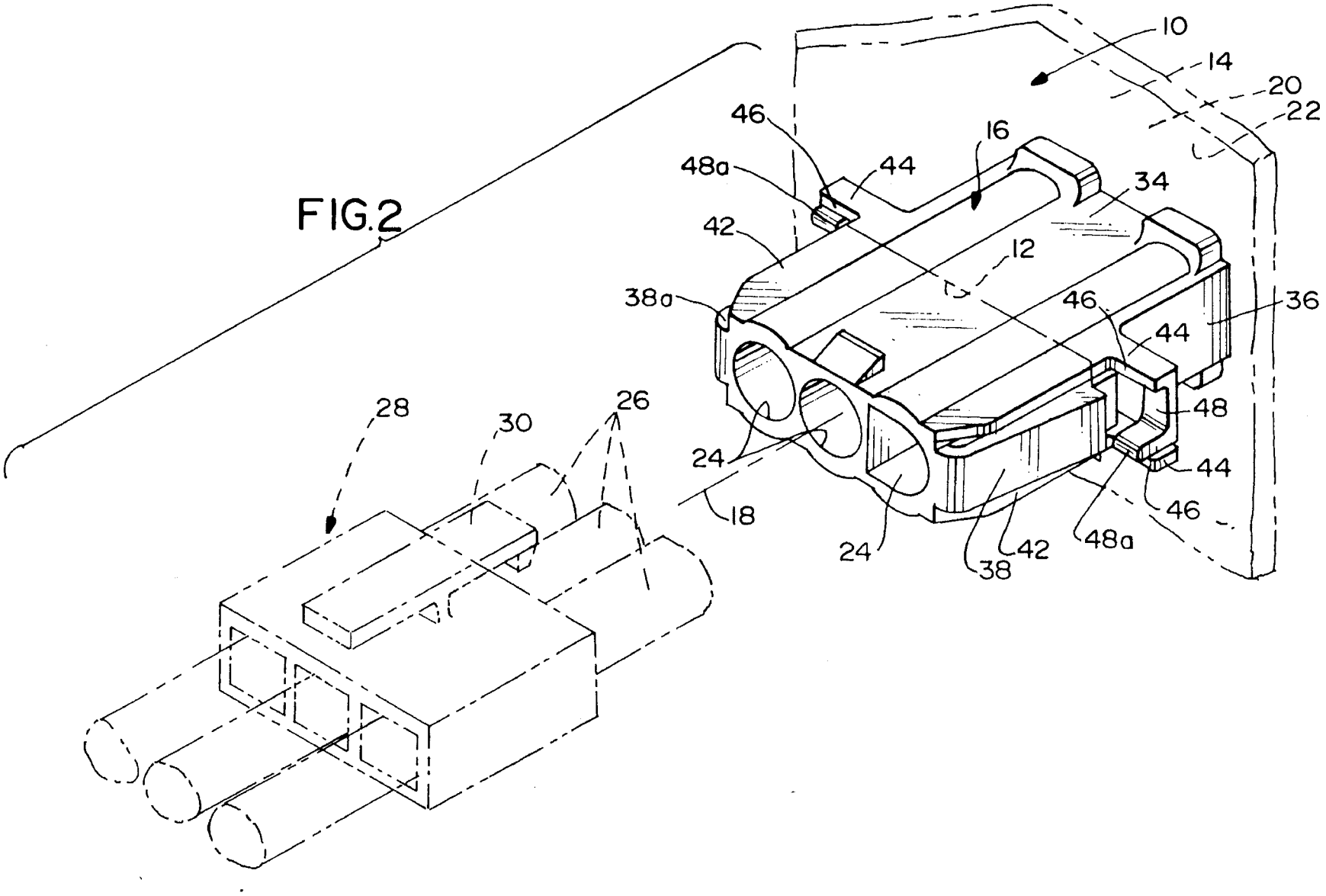
FIG. 2 is a perspective view of the connector mounted in an aperture in a panel shown in phantom, in conjunction with a complementary mating connector also shown in phantom.

Referring to the drawings in greater detail, and first to FIGS. 1 and 2, the invention is embodied in an electrical connector, generally designated 10, adapted for mounting in an aperture 12 (FIG. 2) in a panel 14. The connector includes a one-piece, unitarily molded dielectric housing, generally designated 16, which is insertable along an axis 18 through aperture 12 from a first surface 20 to at least a second surface 22 of panel 14 in the direction of arrow "A" (FIG. 2).

Dielectric housing 16 includes a plurality of terminal-receiving passages 24 for receiving a plurality of terminal-receiving silos 26 of a complementary mating connector, generally designated 28 in FIG. 2. The complementary mating connector includes a latch arm 30 for interengagement with a latch boss 32 on connector 10. Lastly, connector housing 16 is a narrow or low profile structure having major or long side walls 34 and minor or narrow side walls 36. As will be seen hereinafter, all of the major components of the invention, including the latch means and the anti-vibration means, are confined to the narrow side walls 36.

More particularly, the latch means include a flexible latch arm 38 projecting outwardly from each side wall 36. Each latch arm is molded integrally with connector housing 16 so as to be cantilevered from one end 38*a* of the latch arm rearwardly or opposite the insertion direction of the connector. The yielding or free end of the cantilevered latch arm is provided with a locking portion or shoulder 40 which is adapted to engage second surface 22 of panel 14 at the periphery of aperture 12 when the housing is inserted therethrough to its fully inserted position described hereinafter. Each latch arm is located in a channel defined between a pair of generally parallel axially extending ribs 42 projecting from each side wall 36 of the connector housing. Therefore, the flexible latch arms are protected inside the channel between the ribs.

A pair of stop bars 44 protrude outwardly from the rear ends of each pair of ribs 42 on a respective side wall 36. The stop bars define stop shoulders 46 which, in essence, project transversely outwardly of ribs 42 such that the stop shoulders are adapted to engage first surface 20 of panel 14 at the periphery of aperture 12 when connector housing 16 is inserted completely through the aperture to its fully inserted position described hereinafter and when the anti-vibration arm 48 is flexed a preset maximum amount.

A yieldable anti-vibration arm 48 is axially aligned with flexible latch arm 38 and includes a foot 48*a* adapted to engage first surface 20 of panel 14 when the connector housing is inserted through the aperture. Yieldable anti-vibration arm 48 (and its foot 48*a*) is effective to bias locking shoulder 40 of flexible latch arm 38 against second surface 22 of panel 14 irrespective of small variation in panel thicknesses, thereby preventing vibration between the connector and the panel. Since stop bars 44 actually are extensions of ribs 42, both the flexible latch arm 38 and the yieldable anti-vibration arm 48 are located in the channel between the ribs and the bars to confine the operative latch means and anti-vibration means of the invention to the narrow side walls 36 of connector housing 16. This is highly advantageous in designing a thin or low profile miniaturized connector assembly. The entire structural combination of dielectric housing 16, axially extending ribs 42, flexible latch arms 38, stop bars 44 and stop shoulders 46, and yieldable anti-vibration arms 48, all are portions of a unitarily molded structure.

Figure 3:
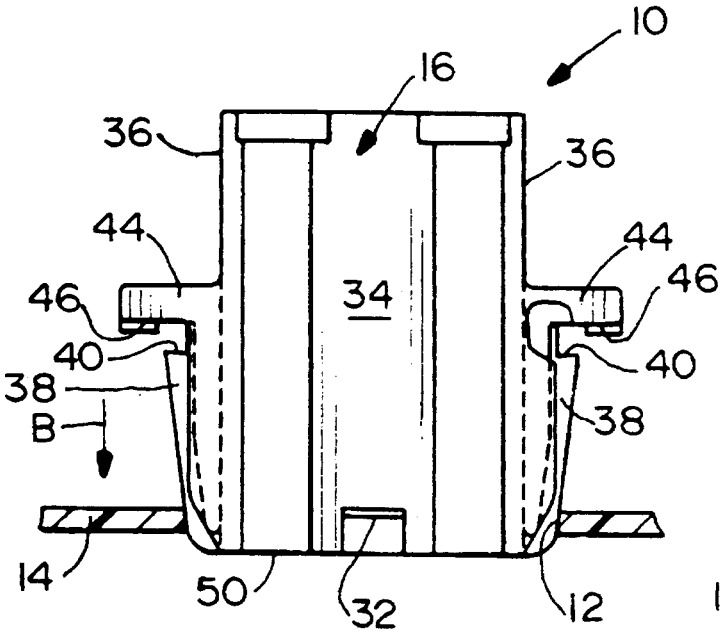
FIGS. 3 and 4 are side and end elevational views, respectively, of the connector in a position just slightly inserted into the aperture in the panel.
Figure 4:
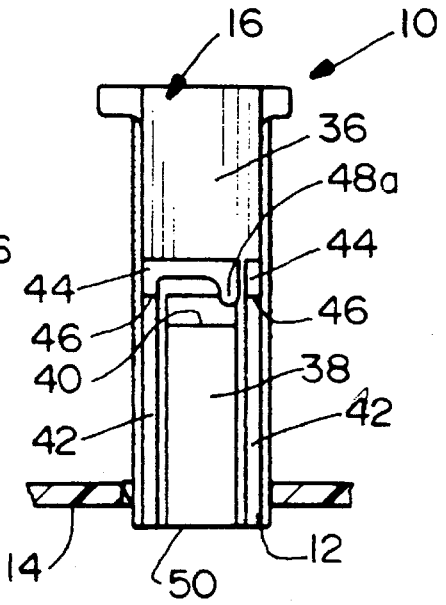

FIGS. 3–8 show sequential views of mounting electrical connector 10 in aperture 12 in panel 14. More particularly, FIGS. 3 and 4 show connector 10 in a position wherein a mating end 50 of connector housing 16 has been just slightly inserted through aperture 12 in panel 14 in the direction of arrow "B". Flexible latch arms 38 have yet to be flexed.

Figure 5:
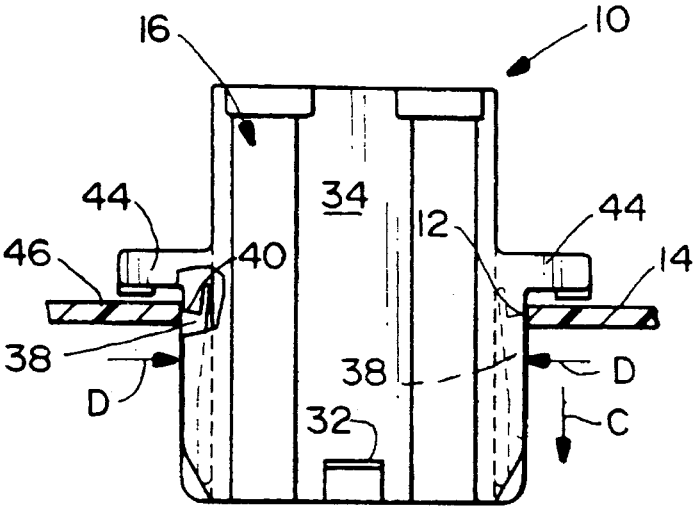
FIGS. 5 and 6 are side and end elevational views, respectively, of the connector inserted through the aperture in the panel just before its fully inserted and latched condition.
Figure 6:
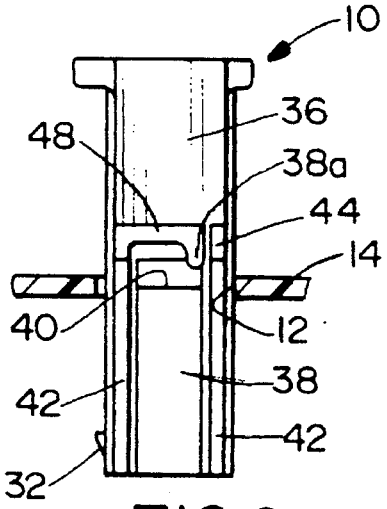

FIGS. 5 and 6 show a position of connector 10 wherein housing 16 has been inserted further through aperture 12 in panel 14 in the direction of arrow "C". The housing has not quite reached its inserted position, but it can be seen how flexible latch arms 38 have been flexed inwardly in the direction of arrows "D" so that the housing and latch arms can pass through the aperture.

Figure 7:
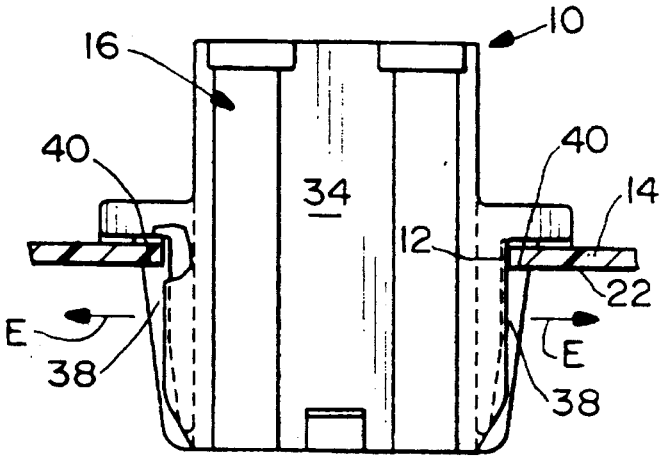
FIGS. 7 and 8 are side and end elevational views, respectively, of the electrical connector in its fully insertion position, with the panel in abutment with the locking portion of the flexible latch arms.
Figure 8:
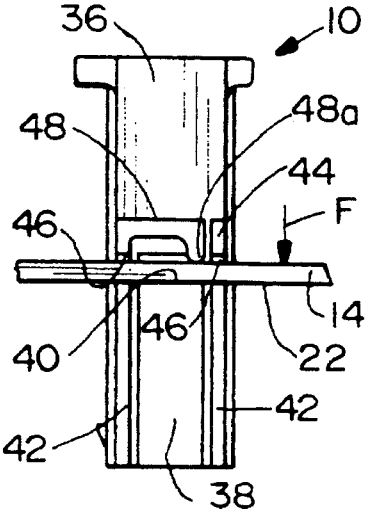

FIGS. 7 and 8 show a position of connector 10 wherein housing 16 has been inserted through aperture 12 in panel 14 to its inserted position. It can be seen that flexible latch arms 38 have resiliently "snapped" back outwardly in the direction of arrows "E" such that locking shoulders 40 of the latch arms are in locking engagement with second surface 22 of the panel at the periphery of aperture 12.

As best seen in FIG. 8, yieldable anti-vibration arms 48, and particularly the feet portions 48*a* thereof, are effective to bias panel 14 in the direction of arrow "F" such that the second surface 22 of the panel is forced against locking shoulders 40 of flexible latch arms 38, thereby preventing vibration between the connector and the panel.

Figure 9:
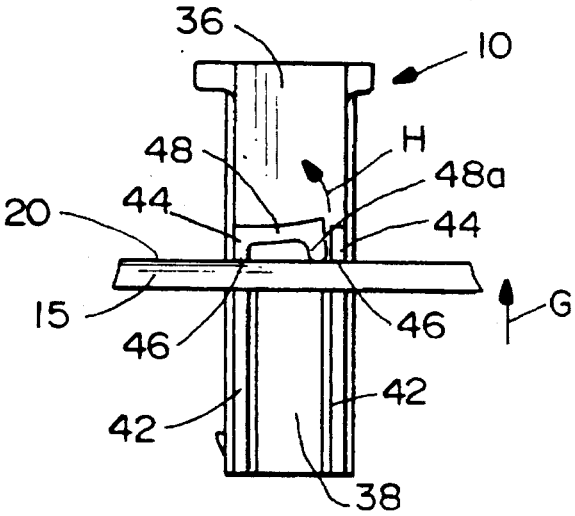
FIG. 9 is an end elevational view of the electrical connector, similar to that of FIG. 8, but with a panel thicker than the panel in the previous Figures in engagement with the stop shoulders and yielding the anti-vibration arm.

FIG. 9 shows that panel 15 having a greater thickness as panel 14 has been moved relative to connector 10 in the direction of arrow "G" under some form of extraneous forces. When this condition exists, it can be seen that yieldable anti-vibration arm 48 simply yields in the direction of arrow "H" to a preset maximum amount to maintain pressure against the first side 20 of the panel 15, thereby preventing rattling of the connector relative to the thicker panel 15. When the extraneous forces represented by arrow "G" do not exist, the yieldable anti-vibration arm will return the connector and panel to the position shown in FIGS. 7 and 8.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A panel mounted electrical connector for mounting in an aperture in a panel, comprising:

a dielectric housing adapted to be inserted along an axis through the aperture from a first surface to at least a second surface of the panel and including at least one side wall;

a pair of generally parallel, axially extending ribs projecting from said side wall and defining a channel therebetween having a given width;

a flexible latch arm having a width slightly less than the given width and located in the channel between said ribs and including a locking portion adapted to engage the second surface of the panel at the periphery of the aperture when the housing is inserted therethrough;

a yieldable anti-vibration arm axially aligned with the flexible latch arm, cantilevered transversely from one of said pair of axially extending ribs toward the second rib of said pair, the anti-vibration arm located away from the side wall outside the channel and having a contact portion located between extensions of planes passing through said axially extending ribs, the contact portion of the anti-vibration arm further adapted to engage the first surface of the panel and to bias the locking portion of the flexible latch arm against the second surface of the panel thereby preventing vibration between the connector and the panel; and rigid stop shoulders projecting transversely outwardly of said ribs and adapted to engage the first surface of the panel at the periphery of the aperture when the housing is inserted completely therethrough and when said anti-vibration arm is flexed a preset maximum amount.

2. The panel mounted electrical connector of claim 1 wherein said flexible latch arm is cantilevered in a direction opposite the insertion direction of the housing.

3. The panel mounted electrical connector of claim 1 wherein said dielectric housing, said axially extending ribs, said flexible latch arm, said stop shoulders and said yieldable anti-vibration arm all are portions of a unitarily molded structure.

4. The panel mounted electrical connector of claim 1 wherein said dielectric housing includes a pair of opposite major, wide side walls and a pair of opposite minor, narrow side walls, and said axially extending ribs, said flexible latch arm, said stop shoulders and said yieldable anti-vibration arm all are located on one of the minor, narrow side walls.

5. The panel mounted electrical connector of claim 4 wherein a structural combination of said axially extending ribs, said flexible latch arm, said stop shoulders and said yieldable anti-vibration arm are located on each minor, narrow side wall of the dielectric housing.

6. A panel mounted electrical connector for mounting in an aperture in a panel, comprising:

a dielectric housing adapted to be inserted along an axis through the aperture from a first surface to at least a second surface of the panel and including at least one side wall;

a flexible latch arm having a given width defined by two edges, the flexible latch arm having a fixed end projecting from said side wall and including a locking portion located at a free end of the flexible latch arm, the locking portion located outwardly of the side wall a given distance, the flexible latch arm adapted to engage the second surface of the panel at the periphery of the aperture when the housing is inserted therethrough;

a rigid stop bar projecting transversely outwardly of said side wall adjacent one edge of the flexible latch arm and located longitudinally beyond the locking portion of the flexible latch arm away from the fixed end, a yieldable anti-vibration arm cantilevered transversely from the stop bar in axial alignment with the flexible latch arm, the anti-vibration arm located outwardly of the side wall beyond the given distance, the locking portion on the flexible latch arm is located and adapted to engage the first surface of the panel and to flex biasing the locking portion of the flexible latch arm against the second surface of the panel thereby preventing vibration between the connector and the panel; and the rigid stop bar adapted to engage the first surface of the panel at the periphery of the aperture when the housing is inserted completely therethrough and when said anti-vibration arm is flexed a preset maximum amount.

7. The panel mounted electrical connector of claim 6 wherein said dielectric housing, said flexible latch arm, said stop bar and said yieldable anti-vibration arm all are portions of a unitarily molded structure.

8. The panel mounted electrical connector of claim 6 wherein said flexible latch arm is cantilevered from said one side wall of the housing.

9. The panel mounted electrical connector of claim 8 wherein said flexible latch arm is cantilevered in a direction opposite the insertion direction of the housing.

10. The panel mounted electrical connector of claim 6 wherein said dielectric housing includes a pair of opposite major, wide side walls and a pair of opposite minor, narrow side walls, and said flexible latch arm, said stop bar and said yieldable anti-vibration arm all are located on one of the minor, narrow side walls.

11. The panel mounted electrical connector of claim 10 wherein a structural combination of said flexible latch arm, said stop bar and said yieldable anti-vibration arm are located on each minor, narrow side wall of the dielectric housing.

12. A panel mounted electrical connector for mounting in an aperture in a panel, comprising:

a dielectric housing adapted to be inserted along an axis through the aperture from a first surface to at least a second surface of the panel and including at least one side wall;

a pair of generally parallel, axially extending ribs projecting from said side wall and defining a channel therebetween;

a flexible latch arm located in the channel between said ribs and including a locking portion adapted to engage the second surface of the panel at the periphery of the aperture when the housing is inserted therethrough;

a yieldable anti-vibration arm axially aligned with the flexible latch arm located between said axially extending ribs, and cantilevered transversely inwardly of one of said axially extending ribs and adapted to engage the first surface of the panel and to bias the locking portion of the flexible latch arm against the second surface of the panel thereby preventing vibration between the connector and the panel; and rigid stop shoulders formed by stop bars projecting transversely outwardly of said ribs, said vibration arm cantilevered inwardly from one of said stop bars and said rigid stop shoulder adapted to engage the first surface of the panel at the periphery of the aperture when the housing is inserted completely therethrough and when said anti-vibration arm is flexed a preset maximum amount.

* * * * *